US009557695B2

(12) United States Patent
Kojima et al.

(10) Patent No.: US 9,557,695 B2
(45) Date of Patent: Jan. 31, 2017

(54) IMAGE FORMING APPARATUS

(71) Applicant: CANON KABUSHIKI KAISHA, Tokyo (JP)

(72) Inventors: Etsuji Kojima, Kashiwa (JP); Tetsuya Ohta, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/819,926

(22) Filed: Aug. 6, 2015

(65) Prior Publication Data

US 2016/0041510 A1 Feb. 11, 2016

(30) Foreign Application Priority Data

Aug. 8, 2014 (JP) ..... 2014-163220

(51) Int. Cl.
*G03G 15/16* (2006.01)
*G03G 15/23* (2006.01)

(52) U.S. Cl.
CPC ..... *G03G 15/235* (2013.01); *G03G 15/1675* (2013.01); *G03G 2215/2035* (2013.01)

(58) Field of Classification Search
CPC ..... G03G 15/235; G03G 15/1675; G03G 2215/2035
See application file for complete search history.

(56) References Cited

U.S. PATENT DOCUMENTS 6,748,192 B2 6/2004 Izawa et al.
2009/0274477 A1* 11/2009 Okamoto ..... G03G 15/2078 399/69
2010/0322684 A1* 12/2010 Kikuchi ..... G03G 15/2042 399/331
2015/0160598 A1* 6/2015 Yagi ..... G03G 15/5029 399/45
2015/0185668 A1* 7/2015 Matsuzaki ..... G03G 15/1675 399/66
2015/0362870 A1* 12/2015 Ogushi ..... G03G 15/1665 399/66

FOREIGN PATENT DOCUMENTS

JP 04007564 A * 1/1992
JP 10-10893 A 1/1998
JP 2003-045615 A 2/2003

* cited by examiner

*Primary Examiner* — David Gray
*Assistant Examiner* — Sevan A Aydin
(74) *Attorney, Agent, or Firm* — Fitzpatrick, Cella, Harper & Scinto

(57) ABSTRACT

An image forming apparatus includes an image bearing member, a voltage source, a fixing device including a rotatable member, an executing portion for executing an operation in a both side mode, and a setting portion. The setting portion sets a transfer voltage in the operation for a second surface so that an absolute value of the transfer voltage when a recording material region, which starts from a most downstream end position and which passed through a fixing portion through a first one full circumference of the rotatable member when the toner image is fixed on a first surface passes through the transfer portion, is greater than an absolute value of the transfer voltage when a recording material region passed through the fixing portion through a second one full circumference of the rotatable member when the toner image is fixed on the first surface passes through the transfer portion.

10 Claims, 7 Drawing Sheets

IMAGE FORMING APPARATUS

FIELD OF THE INVENTION AND RELATED ART

The present invention relates to an image forming apparatus, such as a copying machine, a printer or a facsimile machine, of an electrophotographic type or an electrostatic recording type.

In a conventional image forming apparatus of the electrophotographic type, for example, an electrostatic latent image (electrostatic image) is formed on an electrophotographic photosensitive member as an image bearing member and is developed into a toner image, and then the toner image is transferred onto a recording material such as paper and thereafter is fixed on the recording material. Further, in a color image forming apparatus or the like, there is an intermediary transfer type in which the toner image is once primary-transferred from the photosensitive member as a first image bearing member onto an intermediary transfer member as a second image bearing member and thereafter is secondary-transferred from the intermediary transfer member onto a transfer material.

As a transfer type in which the toner image is transferred from the image bearing member onto the transfer material, there is a contact transfer type. Of the contact transfer type, a roller transfer type excellent in a feeding property of the transfer material at a transfer portion has become common. In the roller transfer type, a transfer roller as a contact transfer member is press-contacted to the image bearing member, so that a transfer nip is formed at the transfer portion between the image bearing member and the transfer roller. Then, while sandwiching and feeding the transfer material in the transfer nip, by the action of a transfer voltage (transfer bias) applied to the transfer roller, the toner image formed on the image bearing member is transferred onto the transfer material.

In the contact transfer type, the transfer voltage (transfer bias) applied to the contact transfer member such as the transfer roller is subjected to constant-voltage control or constant-current control in general. In the case of the constant-voltage control, independently of a width of the transfer material at the transfer portion, it is possible to ensure a voltage in a region where the transfer material exists, so that a desired transfer current is caused to readily flow through the contact transfer member without being influenced by a region where the transfer material does not exist. For that reason, the constant-voltage control has been widely used.

As a control type of the transfer voltage, there is a control type which is called ATVC (active transfer voltage control) type. In the ATVC type, the transfer voltage is subjected to constant-current control at a predetermined current value and is applied when the transfer material does not exist at the transfer portion and a transfer voltage value for transfer is obtained on the basis of a generated voltage value at that time, and during the transfer, the constant-voltage control is effected at the transfer voltage value. In the ATVC control type, a change in electric resistance of the transfer material such as paper is not detected. When a proper transfer voltage is set in the case where an electric resistance value of the transfer material is high (e.g., dry paper), in the case where a transfer material low in electric resistance value (e.g., paper rich in water content) is used, an excessive current flows through the transfer material, so that a transfer void generates in some cases. On the other hand, when the proper transfer voltage is set in the case where the electric resistance value of the transfer material is low, with respect to the transfer material high in electric resistance value, improper transfer due to insufficient electric charge generates in some cases. For that reason, it is desired that the electric resistance value of the transfer material is estimated and then the transfer voltage is set. Particularly, during both-side image formation in which images are formed on both surfaces, i.e., a first surface (front surface) and a second surface (back surface) of the transfer material, a toner image is transferred onto the second surface of the transfer material passed through a fixing portion in order to fix a toner image transferred on the first surface of the transfer material. For that reason, in a fixing step in which the toner image is fixed on the first surface of the transfer material, the transfer material is heated, whereby water is vaporized and the electric resistance of the transfer material increases. Accordingly, when the toner image is transferred onto the second surface of the transfer material, the electric resistance of the transfer material increases compared with when the toner image is transferred onto the first surface of the transfer material, and therefore the transfer voltage is set at a higher level correspondingly.

On the other hand, as a fixing type in which the toner image is fixed on the transfer material, a heating and pressing fixing type in which a fixing portion (fixing nip) is formed by a rotatable fixing member including a heat source and a rotatable pressing member press-contacted to the rotatable fixing member and in the fixing portion, the transfer material is heated and pressed while being sandwiched and fed is used in general. Of the fixing type, a heating roller type in which the transfer material is sandwiched and fed by a fixing roller as the rotatable fixing member and a pressing roller as the rotatable pressing member has been widely used. Further, in recent years, from the viewpoints of quick start and energy saving, a heating device of a film fixing type using a fixing film (fixing belt) as the rotatable fixing member constituted by an endless belt-shaped film has been put into practical use. As the fixing film, a fixing film using a base material formed of a resin material and a fixing film using a base material formed of metal are disclosed in Japanese Laid-open Patent Application 2003-45615. Further, a fixing film including the base material formed of metal and an elastic layer formed on the base material has also been proposed in Japanese Laid-Open Patent Application Hei 10-10893.

However, in the conventional image forming apparatus, during the both-side image formation, it was found that the following problem generated.

In recent years, with downsizing of the image forming apparatus, there is a tendency that a peripheral length (outer diameter) of the rotatable fixing member such as the fixing film becomes small. For that reason, a heat quantity supplied from the rotatable fixing member to the transfer material causes non-uniformity in some cases depending on contact with the rotatable fixing member at the time of rotation through one full circumference. As the rotatable fixing member of the film fixing type, a member having a low thermal capacity is used, but for example, in the case where the elastic layer is provided on the base material of the fixing film as described above, thermal conductivity lowers and a heat accumulation effect is liable to generate. For that reason, an amount of supply of heat from the fixing film to the transfer material largely fluctuates in some cases.

As a result, during the both-side image formation, on the second surface of the transfer material, due to heat supply non-uniformity depending on a rotation period of the fixing film, image density non-uniformity depending on the rotation period generates in some cases. Particularly, in a fixing step of the toner image on the first surface of the transfer material, a difference in image density between a contact portion with the fixing film, placed in advance in a heat-accumulated secondary transfer, during rotation through first one full circumference and a portion other than the contact portion becomes more conspicuous.

That is, with respect to a transfer material feeding direction, an amount of vaporization of water (content) from the transfer material varies depending on the rotation period of the fixing film, so that an electric resistance value of the transfer material fluctuates depending on the rotation period of the fixing film in some cases. For that reason, in the case where the transfer voltage is subjected to constant-voltage control when the toner image is transferred onto the second surface of the transfer material during the both-side image formation, a transfer property is different depending on the rotation period of the fixing film in some cases. As a result, on the second surface of the transfer material during the both-side image formation, the image density non-uniformity depending on the rotation period of the fixing film generates in some cases.

In the above, the case where the rotatable fixing member is the fixing film was described as an example, but a similar problem can generate also in the case where the rotatable fixing member having another constitution such as a fixing roller is used. Further, a similar problem can generate also in the case where the heat quantity supplied from the rotatable fixing member to the transfer material is positively changed between regions different in transfer material feeding direction from the viewpoint of a fixing property or the like.

SUMMARY OF THE INVENTION

The present invention has been accomplished in view of the above circumferences.

According to an aspect of the present invention, there is provided an image forming apparatus comprising an image bearing member for bearing a toner image; a voltage source for applying a transfer voltage to a transfer portion where the toner image is transferred from, the image bearing member onto a recording material; a fixing device, including a rotatable member to be heated, for fixing the toner image on the recording material by heating the recording material, on which the toner image is transferred, at a fixing portion while causing the recording material to contact the rotatable member; an executing portion for executing an operation in a both-side mode, in which the recording material on which the toner image is transferred and fixed on a first surface thereof, is fed to the transfer portion, to which the transfer voltage is applied, where the toner image is transferred onto a second surface of the recording material and then is fixed on the second surface of the recording material by the fixing device to form both-side images; and a setting portion for setting the transfer voltage when the toner image is transferred onto the second surface of the recording material, wherein the setting portion sets the transfer voltage in the operation for the second surface in the both-side mode so that an absolute value of the transfer voltage when a recording material region, which starts from a downstreammost end position with respect to a recording material feeding direction and which passed through the fixing portion through a first one full circumference of the rotatable member when the toner image is fixed on the first surface, passes through the transfer portion is greater than an absolute value of the transfer voltage when a recording material region passed through the fixing portion through a second one full circumference of the rotatable member when the toner image is fixed on the first surface passes through the transfer portion.

These and other objects, features and advantages of the present invention will become more apparent upon a consideration of the following description of the preferred embodiments of the present invention taken in conjunction with the accompanying drawings.

DESCRIPTION OF THE EMBODIMENTS

An image forming apparatus according to the present invention will be described with reference to the drawings.

Embodiment 1

1. General Constitution and Operation of Image Forming Apparatus

Figure 1:
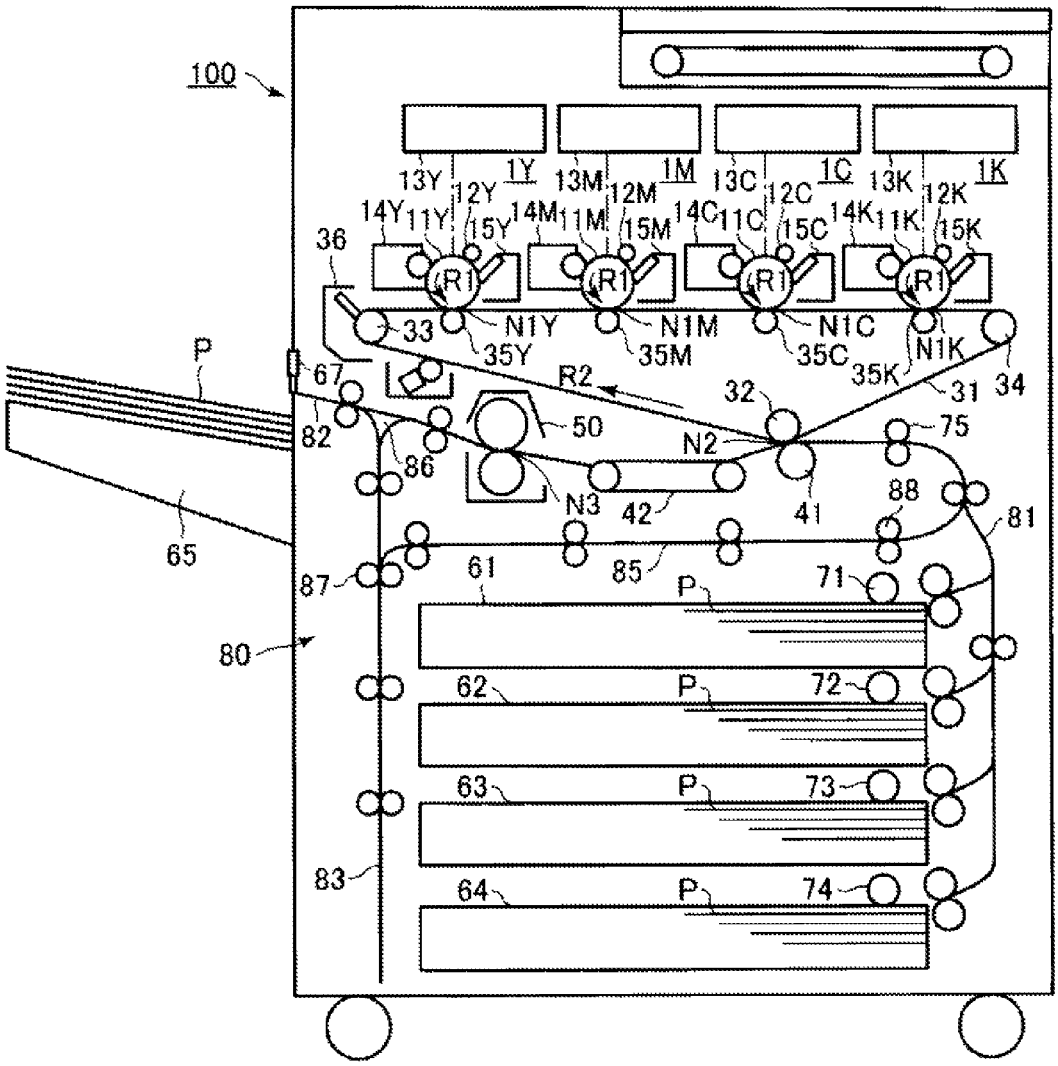
FIG. 1 is a schematic sectional view of an image forming apparatus.

FIG. 1 is a schematic sectional view of an image forming apparatus 100 in this embodiment according to the present invention.

The image forming apparatus 100 in this embodiment is a tandem laser beam, printer (multi-function machine of a copying machine and a printer) which is capable of forming a full-color image on a transfer material P using an electrophotographic type and which employs an intermediary transfer type.

The image forming apparatus 100 includes, as a plurality of image forming portions, first to fourth image forming portions 1Y, 1M, 1C and 1K for forming images of yellow (Y), magenta (M), cyan (C) and black (K), respectively. In this embodiment, constitutions and operations of the image forming portions 1Y, 1M, 1C and 1K are substantially the same except that the colors of toners used are different from each other. Accordingly, in the following, in the case where particular distinction is not required, suffixes Y, M, C and K for representing elements for associated image forming portions 1Y, 1M, 1C and 1K, respectively, are omitted, and the elements will be collectively described.

At the image forming portion 1, a photosensitive drum 11 which is a drum-shaped (cylindrical) electrophotographic photosensitive member as a first image bearing member is provided. The photosensitive drum 11 is rotationally driven in an arrow R1 direction. At a periphery of the photosensitive drum 11, along a rotational direction of the photosensitive drum 11, the following process devices each constituting the image forming portion 1 are provided. First, a charging roller 12 which is a roller-shaped charging member as a charging means is disposed. Next, an exposure device (laser scanner device) 13 as an exposure means is disposed. Next, a developing device 14 as a developing means is disposed. Next, primary transfer rollers 35 which are roller-shaped primary transfer members as primary transfer means are disposed. Next, a drum cleaning device 15 as a photosensitive member cleaning means is disposed.

Further, an intermediary transfer belt 31 which is an intermediary transfer member as a second image bearing member is disposed so as to oppose the photosensitive drums 11 of the image forming portions 1. The intermediary transfer belt 31 is constituted by an endless belt and is stretched by, as a plurality of stretching members, a driving roller 33, a tension roller 34 and a secondary transfer opposite roller 32. The intermediary transfer belt 31 is rotationally driven in an arrow R2 direction by the driving roller 33. In an inner peripheral surface side of the intermediary transfer belt 31, at positions opposing the photosensitive drums 11Y, 11M, 11C and 11K, the above-described primary transfer rollers 35Y, 35M, 35C and 35K are disposed. Each of the primary transfer rollers 35 is urged (pressed) against the intermediary transfer belt 31 toward the associated photosensitive drum 11, so that a primary transfer portion (primary transfer nip) N1 where the intermediary transfer belt 31 and the photosensitive drum 11 contact each other is formed. Further, in an outer peripheral surface side of the intermediary transfer belt 31, at a position opposing the secondary transfer opposite roller 32, a secondary transfer roller 41 which is a roller-shaped transfer member as a secondary transfer means is disposed. The secondary transfer roller 41 is urged (pressed) against the intermediary transfer belt 31 toward the secondary transfer opposite roller 32, so that a secondary transfer portion (secondary transfer nip) N2, where the intermediary transfer belt 31 and the secondary transfer roller 41 contact each other, is formed. Further, in the outer peripheral surface side of the intermediary transfer belt 31, at a position opposing the driving roller 33, a cleaning device 36 as an intermediary transfer member cleaning means is disposed.

An electric resistance of the intermediary transfer belt 31 may preferably be $10^6$-$10^{12}$ Ωcm in volume resistivity. As a material for the intermediary transfer belt 31, an elastic material such as a urethane-based resin, a nylon-based resin, polyimide resin, silicone rubber or hydrin rubber, or a material obtained by dispersing carbon black or electroconductive powder into these materials to adjust the electric resistance can be used. In this embodiment, the intermediary transfer belt 31 was constituted by providing a 20 μm-thick surface layer of a fluorine-containing resin material of $10^7$ Ωcm in volume resistivity on a 0.5 mm-thick base layer obtained by dispersing carbon black in hydrin rubber so as to adjust the volume resistivity to $10^7$ Ωcm. Tension of the intermediary transfer belt 31 varies depending on the material, but may preferably be set so that an elongation percentage is 1% or less to prevent generation of breakage or permanent deformation of the belt. In this embodiment, the tension was set so that a load of 150 N was applied to the intermediary transfer belt 31. Further, in this embodiment, the primary transfer roller (electroconductive roller) 35 obtained by coating a core metal with an elastic material having a medium resistance (volume resistivity of $10^4$-$10^{10}$ Ωcm) was used. Further, in this embodiment, the secondary transfer roller (electroconductive roller) 41 obtained by coating a core metal with an EPDM foam layer having the medium resistance (volume resistivity of $10^4$-$10^{10}$ Ωcm) was used. Each of the primary transfer roller 35 and the secondary transfer roller 41 is press-contacted to the intermediary transfer belt 31 toward an associated one of the photosensitive drum 11 and the secondary transfer opposite roller 32 at a total pressure of about 5-20 N.

During the image formation, the photosensitive drum 11 is rotationally driven in an arrow R1 direction in FIG. 1 at a predetermined peripheral speed (process speed: 100 mm/sec in this embodiment) by an unshown driving device. The surface of the photosensitive drum 11 is electrically charged uniformly by the charging roller 12 in a rotation process thereof. The charged surface of the photosensitive drum 11 is irradiated with laser light which is emitted from the exposure device 13 and which is modulated by an image information signal sent from a host computer. As a result, an electrostatic latent image (electrostatic image) is formed on the surface of the photosensitive drum 11. Intensity and irradiation spot diameter of the laser light are properly set depending on a resolution of the image forming apparatus 100 and a desired image density. The electrostatic latent image on the photosensitive drum 11 is formed by maintaining a portion irradiated with the laser light at a light-portion potential VL (about −100 V) and a portion which is not irradiated with the laser light at a dark-portion potential VD (about −700 V) which is the charged potential as it is. The electrostatic latent image formed on the photosensitive drum 11 is developed (visualized) into a toner image with a toner, charged to the same polarity (negative in this embodiment) as a charge polarity of the photosensitive drum 11, by the developing device 14 at a developing position where the photosensitive drum 11 and the developing device 14 oppose to each other.

The intermediary transfer belt 31 is rotationally driven, in an arrow R2 direction in FIG. 1 in synchronism with the photosensitive drums 11, by an unshown driving device. The toner image formed on the photosensitive drum 11 is transferred (primary-transferred) onto the intermediary transfer belt 31 at the primary transfer portion N1 by the action of the primary transfer roller 35. At this time, to the primary transfer roller 35, from an unshown primary transfer voltage source (power source) as an application means, a primary transfer voltage (primary transfer bias) of an opposite polarity (positive in this embodiment) to a charge polarity (normal charge polarity) of the toner during development is applied. As a result, an electric field is formed at the primary transfer portion N1, so that the toner image is primary-transferred by this electric field. For example, during full-color image formation, the respective color toner images formed at the respective image forming portions 1Y, 1M, 1C and 1K are superposedly primary-transferred successively onto the intermediary transfer belt 31 at the primary transfer portions N1Y, N1M, N1C and N1K, respectively. As a result, multi-color toner images for a full-color image consisting of the four color toner images are obtained.

The toner (primary transfer residual toner) remaining on the surface of the photosensitive drum 11 after the end of the primary transfer of the toner-image is removed from the surface of the photosensitive drum 11 by the drum cleaning device 15 and is collected in the drum cleaning device 15.

In synchronism with progress of the primary transfer of the toner image onto the intermediary transfer belt 31, the transfer material F is supplied to the secondary transfer portion N2. Then, the toner image on the intermediary transfer belt 31 is transferred (secondary-transferred) onto the transfer material F at the secondary transfer portion N2 by the action of the secondary transfer roller 41. At this time, to the secondary transfer roller 41, from a secondary transfer voltage source E (FIG. 3) as an application means, a secondary transfer voltage (secondary transfer bias) of an opposite polarity to the charge polarity of the toner during the development is applied. As a result, an electric field is formed at the secondary transfer portion N2, so that the toner image is secondary-transferred by this electric field. During the full-color image formation, the four color toner images on the intermediary transfer belt 31 are collectively secondary-transferred onto the transfer material P.

The transfer material P such as a recording sheet (paper) is accommodated in each of transfer material cassettes 61, 62, 63 and 64 as a plurality of accommodating portions for accommodating the transfer material P, and is fed to a supplying and feeding path 81 by rotation of associated one of supplying (feeding) rollers 71, 72, 73 and 74. Further, a registration roller pair 75 supplies the transfer material P, fed along the supplying and feeding path 81, to the secondary transfer portion N2 by timing the transfer material P to the toner image on the intermediary transfer belt 31.

The transfer material P, on which the toner image is transferred, is separated from the intermediary transfer belt 31 and then is fed to a fixing device 50 as a fixing means by a feeding belt 42. The transfer material P is heated and pressed by being nipped and fed in a fixing portion (fixing nip) N3 in the fixing device 50, so that the toner image is fixed on the transfer material P. The fixing device 50 will be described hereinafter in detail. Thereafter, the transfer material P passes through a discharging feeding path 82 and is, after being subjected to charge removal by a charge-removing brush 67, discharged and stacked on a discharge tray 65. Here, a distance from, the secondary transfer portion N2 to the charge-removing brush 67 is set at 30 mm to 200 mm for downsizing the image forming apparatus.

The toner (secondary transfer residual, toner) remaining on the surface of the intermediary transfer belt 31 after the end of the secondary transfer of the toner image is removed from the surface of the intermediary transfer belt 31 by the belt cleaning device 36 and is collected in the belt cleaning device 36.

The image forming apparatus 100 in this embodiment is capable of executing one-side (one-surface) image formation in which the toner image is fixed on one surface of the transfer material P and then the transfer material P is outputted and both-side (double-side) image formation in which the toner images are fixed on both of a first surface (front surface) and a second surface (back surface) of the transfer material P and then the transfer material P is outputted. In the both-side image formation, after the toner image is fixed on the first surface of the transfer material P, the toner image is transferred and fixed on the second surface of the transfer material P, and then the transfer material P is outputted. For that purpose, the image forming apparatus 100 includes a feeding device 80 for both-side image formation as a feeding means, for both-side image formation, for feeding the transfer material P again to the secondary transfer portion N2 after turning upside down the transfer material P on which the toner image is fixed by the fixing device 50. In this embodiment, the feeding device 50 for both-side image formation is constituted by a reverse feeding path 83, a feeding path 85 for both-side image formation, a flapper 86, a switch-back roller 87, a supplying roller 38 and the like. During the one-side image formation, the transfer material P on which the toner image is fixed on one surface is discharged from the fixing device 50, and thereafter is sent to the discharge feeding path 82 by the flapper 86 and then is discharged onto the discharge tray 65. During the both-side image formation, the transfer material P on which the toner image is fixed on the first surface is discharged from the fixing device 50 and thereafter is sent to the feeding path 85 for both-side image formation by the flapper 86, and the transfer material P is switched in feeding direction by the switch-back-roller 87 and then is sent to the feeding path 85 for both-side image formation. Thereafter, the transfer material P is fed to the secondary transfer portion N2 by the supplying roller 88 for both-side image formation in a state in which the second surface faces the intermediary transfer belt 31. Then, the transfer material P on which the toner image is transferred on the second surface is sent into the fixing device 50 again, so that the toner image is fixed on the second surface of the transfer material P. Thereafter, the transfer material P on which the toner images are fixed on the both surfaces is sent, after being discharged from the fixing device 50, to the discharging feeding path 82 by the flapper 86 and then is discharged on the discharge tray 65. According to such a feeding method, a leading end of the transfer material P with respect to the transfer material feeding direction when the transfer material P passes through the secondary transfer portion N2 and the fixing portion N3 during the image formation of the toner image on the image surface of the transfer material P is a trailing end of the transfer material P with respect to the transfer material feeding direction when the transfer material P passes through the secondary transfer portion 2 and the fixing portion N3 during the image formation of the toner image on the second surface of the transfer material P.

2. Fixing Device

Figure 2:
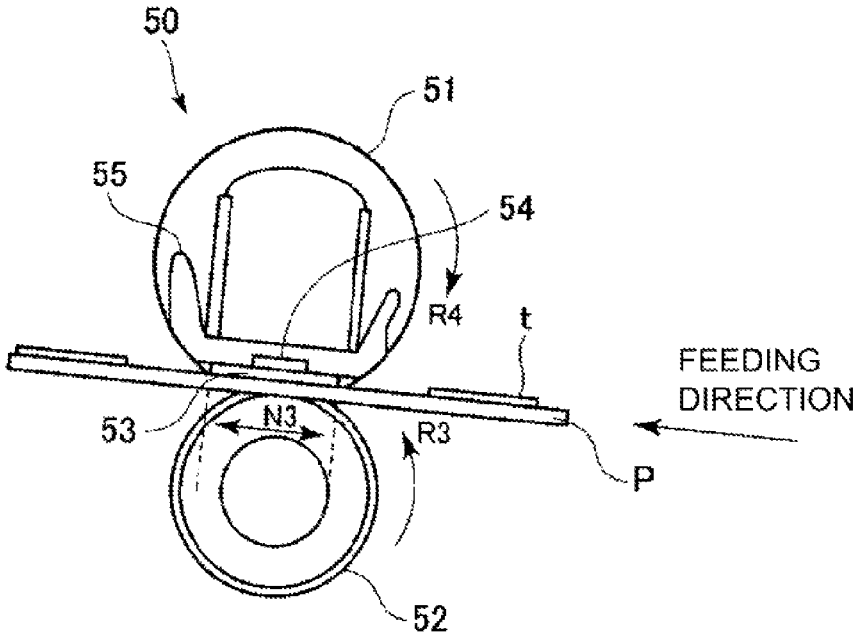
FIG. 2 is a schematic sectional view of a fixing device.

The fixing device 50 will be described. In this embodiment, the fixing device 50 is constituted by the heating device of the film heating type as a heating means. The fixing device 50 includes the fixing film (fixing belt) 51 constituted by an endless belt-shaped (sleeve-shaped) heat-resistant film as the rotatable fixing member. Further, the fixing device 50 includes a pressing roller 52 as a rotatable pressing member. Further, the fixing device 50 includes a ceramic heater 53 as a heating member. The fixing film 51 is sandwiched between the heater 53 and the pressing roller 52, so that the fixing portion (fixing nip) N3 which is a press-contact portion as a heating portion is formed. The fixing film 51 is externally engaged with a holder 55 with an allowance (margin). The fixing film 51 is rotated in an arrow R4 direction in FIG. 2 by rotational drive of the pressing roller 52 in an arrow R4 direction in FIG. 2 while sliding with the holder 55 and the heater 53. On the back surface of the heater 53, a thermistor 54 as a temperature detecting means is provided. In the fixing portion N3, between the fixing film 51 and the pressing roller 52, the transfer material P on which an unfixed toner image t is carried is introduced, and then is sandwiched and fed together with the fixing film 51 between the heater 53 and the pressing roller 52. As a result, while applying heat of the heater 53 to the transfer material P through the fixing film 51, pressure is applied to the transfer material P in the fixing portion N3 by the pressing roller 52, so that the unfixed toner image t is fixed on the surface of the transfer material P.

According to the heating device of the film heating type, it is possible to constitute the fixing device 50 of an on-demand type by using a low-thermal-capacitor member as each of the heater 53 and the fixing film 51. As a result, the heater 53 as the heat source may only be required to be heated up to a predetermined fixing transfer material by supplying electric power (energy) to the heater 53 only during execution of the image forming operation. For that reason, it is possible to obtain advantages that a waiting time from main switch-on of the image forming apparatus 100 until the image forming apparatus 100 is in an executable state of the image forming operation is short and that an amount of electric power consumption during stand-by is considerably small.

As the fixing film 51, a firm using a heat-resistant resin film as a base material can be used. In this case, the fixing film 51 may preferably be formed in a small thickness of, e.g., 20-70 μm in order to efficiently supply heat of the heater 53 to the transfer material P as a member-to-be-heated in the fixing portion IB. The fixing film 53 is, e.g., constituted by three layers consisting of a film base layer (base material), an electroconductive printer layer and a parting layer. The film base layer is formed of a high-insulating material such as polyimide, polyamideimide or PEEK in a thickness of about 15-60 μm, thus having a heat-resistant property, high elasticity and flexibility. By the film base layer, mechanical strength of the fixing film 51, such as tensile strength of the fixing film 51 as a whole is maintained. The electroconductive primer layer is formed as a thin layer having a thickness of about 2-6 μm, and is electrically connected to the ground in order to prevent charge-up of the fixing film 51 as a whole. The parting layer is a toner offset-preventing layer with respect to the fixing film 51, and is formed by coating the electroconductive primer layer with an about 5-14 μm-thick layer of a fluorine-containing resin material, such as PFA, PTFS or FSP, having a good parting property.

On the other hand, in recent years, with speed-up and colorization of the image forming apparatus, a metal-made film is used as the fixing film. That is, as the base material for the fixing film 51, the heat-resistant resin material as described above has been used in general. However, with the speed-up of tine image forming apparatus, it has been desired that thermal conductivity of the fixing film 51 is increased and thus heat of the heater is efficiently conducted to the transfer material. For that reason, as the base material for the fixing film 51, the film (sleeve) made of the metal material, higher in thermal conductivity than the resin material is used. Specifically, in this case, it is preferable that the fixing film 51 is formed in a thickness of 100 μm or less and is constituted so that the base layer (base material) is formed with a member of pure metal of SUS, Al, Hi, Cu, Zn or the like or a member of an alloy of the metals. This is because the thermal capacity of the fixing film 51 is made sufficiently small and thus image formation can be quickly started. Further, the base layer (base material) may preferably have sufficient strength and excellent durability, i.e., having a thickness of 20 μm or more in order to realize life-time extension of the fixing device 50. That is, in this case, the thickness of the fixing film 51 may preferably be 20 μm or more and 100 μm or less. Further, in order to ensure offset prevention and a transfer material separating property, the surface layer of the fixing film 51 can be coated with a heat-resistant resin material, having a good parting property, including a fluorine-containing resin material such as PTES, PFA or FEP, or silicone resin.

On the metal-made base material of the fixing film 51, an elastic layer can be provided. That is, at a portion where the toner images are transferred superposedly, the surface of the fixing film 51 cannot follow the shape of the toner images, so that fixing property non-uniformity partly generates in some cases. This fixing property non-uniformity appears as uneven glossiness of the image. Further, with respect to an OHT sheet (a transparent sheet for an overhead projector), light-transmissive property non-uniformity generates, and this light-transmissive property non-uniformity appears as image defect when the image is projected. Therefore, by providing the elastic layer on the base material of the fixing film, the elastic layer is deformed along a toner layer, so that the toner non-uniformly placed on the fixing film as in the case of, e.g., the superposed multiple toner images for the full-color image is enclosed by the elastic layer. As a result, heat is uniformly supplied to the toner, so that uniform fixing of the toner image can be easily made.

The present invention can be applied to the case where the fixing film 51 having either one of the above-described constitutions is used, but in this embodiment, particularly, the fixing film 51 using a SUS-made film (sleeve) as the base layer (base material) was used. Onto this SDS-made base layer, the electro-conductive primer layer in which an electroconductive material such as carbon black was dispersed in a proper amount was applied. Then, on the electroconductive primer layer, the parting layer was formed in order to ensure prevention of deposition of the toner and paper powder and a separating property of the transfer material P from the fixing film 51. The parting layer was formed by applying, onto the primer layer, a mixed liquid of PTFE and PFA as a fluorine-containing resin material having an excellent parting property and a high heat-resisting property by a dipping (coating) method and then by baking the mixed liquid. The base layer, the primer layer and the patting layer described above constitute the fixing film 51 of 23.5 mm in outer diameter (about 14 mm in peripheral length).

On the other hand, the pressing roller 52 is constituted by forming, outside a core metal, an elastic layer of a heat-resistant rubber, such as silicone rubber or fluorine-containing rubber, or an elastic layer formed by foaming silicone rubber. Further, on this elastic layer, a parting layer of PFA, PTFE, FEP or the like may also be formed.

Figure 3:
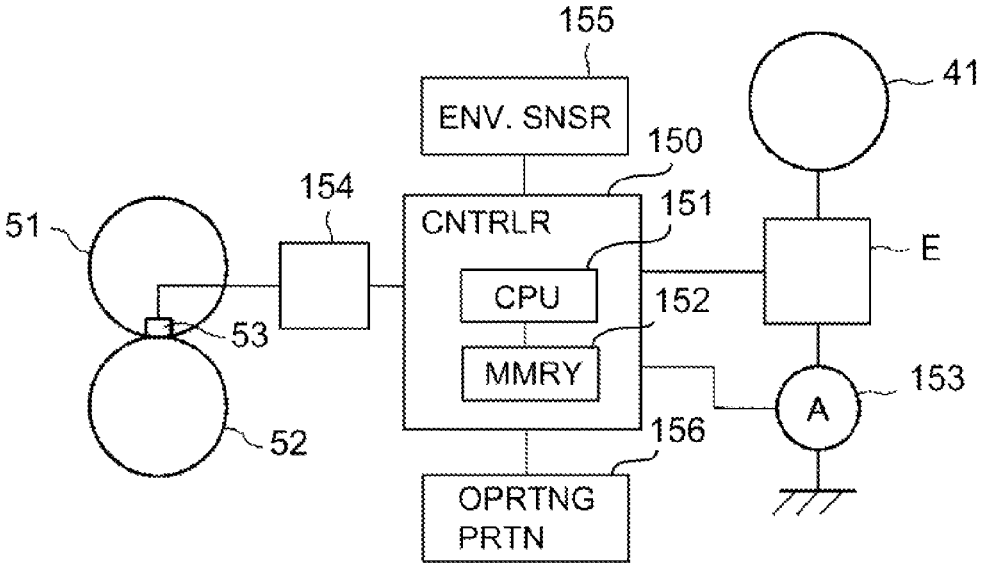
FIG. 3 is a block diagram showing a control mode in Embodiment 1 of the present invention.

Temperature control of the fixing film 51 is effected in the following manner. That is, an output of the thermistor 54 as a temperature detecting element provided on the heater 53 is inputted into CPU 151 of a controller 150 (FIG. 3). Then, on the basis of information thereof, the controller 150 effects control of a phase, a wave number and the like of an AC voltage supplied to the heating member of the heater 53 by a triac of a driving circuit 154 (FIG. 3) for the fixing device 50. As a result, electric power supplied to the heating member of the heater 53 is controlled and thus an amount of heat generation of the heater 53 is controlled, so that temperature control of the fixing device 50 is effected. In this embodiment, the fixing device 50 is temperature-controlled with such a target that the temperature thereof is made constant at a predetermined transfer material. However, as described later, in some cases, the fixing film 51 accumulates heat, so that the thermal quantity supplied to the transfer material P is different between, e.g., rotation through first one full circumference and rotation of subsequent one full circumference.

3. Control Mode

FIG. 3 shows a control mode of a principal part of the image forming apparatus 100 in this embodiment. The controller 150 as a control means provided in the image forming apparatus 100 is constituted by including the CPU 151 which is a central element for performing computation and including a memory 152 such as ROM and RAM, and so on. In the RAM, a sensor detection result, a computation result and the like are stored, and in the ROM, a control program, a data table obtained in advance, and the like are stored. With the controller 150, each of objects-to-be-controlled in the image forming apparatus 100 is connected. Particularly, in this embodiment, a secondary transfer voltage source S, an ammeter (current detecting means) 153, the driving circuit 154 for the fixing device 50, an environment sensor (temperature and humidity sensor) 155 as an environment detecting means, an operating portion 156 as an inputting means, and the like are connected with the controller 150. In this embodiment, the controller 150 effects integrated control of the respective portions of the image forming apparatus 100. Particularly, in this embodiment, the controller 150 executes ATVC of a secondary transfer voltage, correction control of the secondary transfer voltage which are described later, and the like.

4. ATVC

The ATVC of the secondary transfer voltage will be described. The image forming apparatus 100 performs a series of image forming operations (job) which is started by a start instruction (command) and in which an image is formed on a single or a plurality of transfer materials P and then the transfer materials P are outputted. The job generally includes an image forming step (printing step), a pre-rotation step, a sheet interval (transfer material interval) step in the case where the image is formed on the plurality of the transfer materials P, and a post-rotation step. The image forming step is a period in which formation of the electrostatic latent image, formation of the toner image, and primary transfer and secondary transfer of the toner image are actually performed. The pre-rotation step is a period in which a preparatory operation before the image forming step is performed. The sheet interval step is a period corresponding to an interval between a transfer material P and a subsequent transfer material P when the image forming step is continuously per formed with respect to the plurality of transfer materials P. The post-rotation step is a period in which an arranging operation (preparatory operation) after the image forming step is performed.

In this embodiment, a set voltage value of the secondary transfer voltage applied from the secondary transfer voltage source S to the secondary transfer roller 41 during the secondary transfer in the job is determined by the ATVC effected in the pre-rotation step of the job. In the ATVC, when there is no transfer material P at the secondary transfer portion N2, a voltage subjected to constant-current control at a predetermined current value (target current value) is applied to the secondary transfer roller 41, so that a predetermined current is caused to flow through the secondary transfer portion N2 and a generated voltage value at that time is obtained. Then, on the basis of the generated voltage value, the set voltage value of the secondary transfer voltage is determined, and during the secondary transfer, the secondary transfer voltage is subjected to constant-voltage control at the set voltage value. The set voltage value determined by the ATVC may also be the generated voltage value itself in the ATVC and may also be a voltage value determined depending on the generated voltage value on the basis of a computing expression or a look-up table obtained in advance.

As shown in FIG. 3, the image forming apparatus 100 includes the ammeter (current detecting circuit) 153 as a detecting means for detecting a current flowing into the secondary transfer roller 41 when the voltage is applied from the secondary transfer voltage source S as an applying means to the secondary transfer roller 41. Then, in the ATVC, the controller 150 increases or decreases an output of the secondary transfer voltage source S so that a value of a current detected by the ammeter 153 is constant at a target current value, so that the controller 150 can obtain an output setting value of the secondary transfer voltage source E at that time as the generated voltage value. The ammeter 153 is an example of a detecting means for detecting a value correlating with an electric resistance of the secondary transfer portion N2 by applying the voltage to the secondary transfer roller 41 by the secondary transfer voltage source E.

In this embodiment, the target current value of the secondary transfer voltage in the ATVC is set by a current value required during the secondary transfer. This target current value is, similarly as a correction voltage Vpα described later, set in advance depending on an environment and a species (paper-species) of the transfer material P.

In this embodiment, the secondary transfer portion P2 which is a transfer portion where the toner image is transferred onto the transfer material P will be particularly described, but also in the primary transfer portion N1, the ATVC of the primary transfer voltage is effected in the pre-rotation step of the job.

The ATVC can also be effected at arbitrary timing during non-image formation (such as the pre-rotation step, the sheet interval step, the post-rotation step or the like) other than the image forming step.

5. Correction Control of Secondary Transfer Voltage

In this embodiment, the process speed is set at 100 mm/sec. Further, in this embodiment, the outer diameter of the fixing film 51 is set at 23.5 mm, so that the peripheral length (also referred to as "rotation period") of the fixing film 51 is 74 mm. In this embodiment, the case where in an H/H environment (temperature: 30° C., humidity: 80% RH), both-side image formation is performed by feeding A4-sized paper as the transfer material P in a longitudinal direction will be described. In this embodiment, a value of an optimum current applied to the secondary transfer portion N2 is 20 μA.

First, referring to FIG. 4, a relationship between a current and a voltage at the secondary transfer portion N2 in the case where the control in this embodiment is not effected as a comparison example (prior art) will be described. Also in the case of the comparison example, a constitution of the image forming apparatus 100 is substantially the same as that in this embodiment (Embodiment 1) except that the control in this embodiment is not effected.

Figure 4:
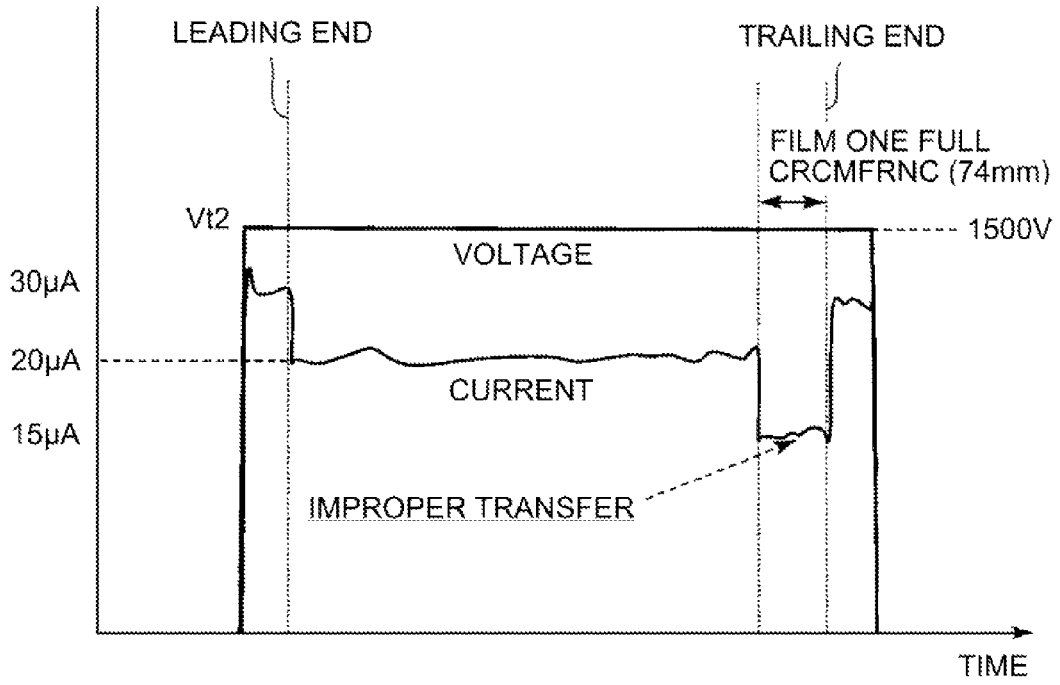
FIG. 4 is a time chart showing a relationship between a current and a voltage at a transfer portion during transfer of a toner image on a second surface in both-side image formation in a comparison example.

FIG. 4 shows the relationship between the current and the voltage at the secondary transfer portion N2 before and after the toner image is secondary-transferred onto the second surface of the transfer material P in the both-side image formation.

When the ATVC was effected by causing the constant current of 20 μA to flow through the secondary transfer portion N2, a generated voltage Vt when there was no paper at the secondary transfer portion N2 was 1000 V. A set voltage Vt1 during the secondary transfer of the toner image on the first surface of the transfer material P in the both-side image formation is set at the generated voltage Vst in the ATVC (Vt1=Vt+Vp1 (Vp1=0 in this case)). In the both-side image formation, a sheet sharing voltage Vp2 on the second surface is set at 500 V, and a set voltage Vt2 during the secondary transfer of the toner image on the second surface of the transfer material P is set at 1500 V (Vt2=Vt+Vp2). This is because as described above, during the secondary transfer of the toner image on the second surface in the both-side image formation the water (content) evaporates from the transfer material P in the fixing of the toner image on the first surface of the transfer material P and an electric resistance of the transfer material P increases, and therefore the secondary transfer voltage is set at a value higher than that during the secondary transfer of the toner image on the first surface of the transfer material P.

As shown in FIG. 4, from the time when the transfer material P reaches a position of 10 mm in front of the secondary transfer portion N2, constant voltage control of the secondary transfer voltage is started. From FIG. 4, it is understood that a current of 30 μA flows into the secondary transfer portion N2 before the transfer material P enters the secondary transfer portion N2. Further, from FIG. 4, it is understood that a current of 20 μA flows into the secondary transfer portion N2 after the transfer material P enters the secondary transfer portion N2. Thereafter, in a range from a trailing end of the transfer material P to a position of 14 mm (one full circumference of the fixing film 1) toward a leading end of the transfer material P, it is understood that only a current of 15 μA flows into the secondary transfer portion N2. As a result, with respect to a feeding direction of the transfer material P, a density non-uniformity (image density non-uniformity) generates between a region from the trailing end of the transfer material P to the position of 74 mm toward the leading end of the transfer material P and a region from the position of 74 mm to the leading end.

Figure 5:
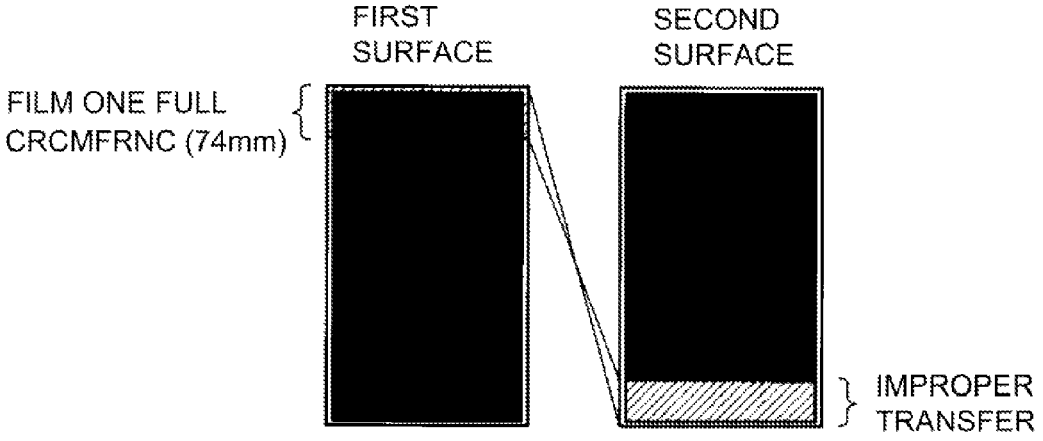
FIG. 5 is a schematic view for illustrating image density non-uniformity generating on the second surface in the both-side image formation.

FIG. 5 schematically shows the image density non-uniformity generating on the second surface of the transfer material P in the both-side image formation. A region of the trailing end of the transfer material P on the second surface to the position of 74 mm toward the leading end in the both-side image formation corresponds to a region of the leading end of the transfer material P on the first surface to the position of 74 mm toward the trailing end. As described above, in a leading end portion (a trailing end portion on the second surface) of the transfer material P on the first surface in the both-side image formation, at a portion contacting the fixing film 1 during rotation of first one full circumference, the heat quantity larger than the heat quantity at another portion is supplied to the transfer material P. For that reason, at the leading end portion (the trailing end portion on the second surface) of the transfer material P on the first surface in the both-side image formation, the water evaporates from the transfer material (paper in this case) P in an amount larger than that at another portion, so that the leading end portion of the transfer material P on the first surface is a portion higher in electric resistance than another portion. As a result, at the leading end portion (the trailing end portion on the second surface) of the transfer material P on the first surface in the both-side image formation, compared with another portion, an amount of a transfer current becomes small.

Figure 6:
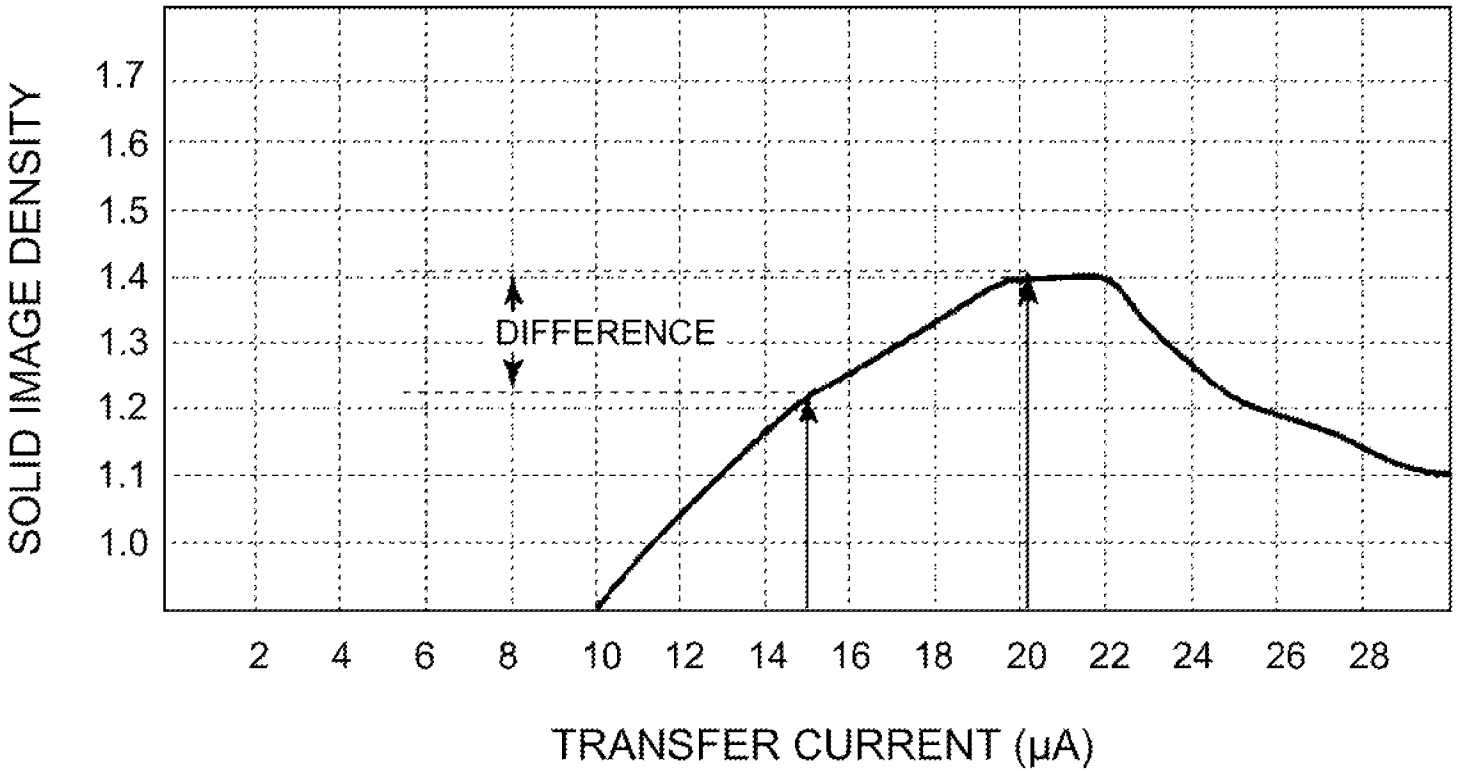
FIG. 6 is a graph showing a relationship between a transfer current and an image density.

FIG. 6 shows an example of a relationship between the transfer current and a solid image density on the transfer material P. It is understood that by increasing the transfer current, a transfer property is improved and thus the image density increases. When the transfer current is further increased, the image density rather decreases. This is because reverse transfer (transfer back) generates due to an excessive transfer current. As described above, the transfer property is different between the case where the transfer current is 20 μA and the case where the transfer current is 15 μA, so that it is understood that in the case where the transfer current is 15 μA, a density difference (image density non-uniformity) by which the image density is poor (small) is visualized.

Figure 7:
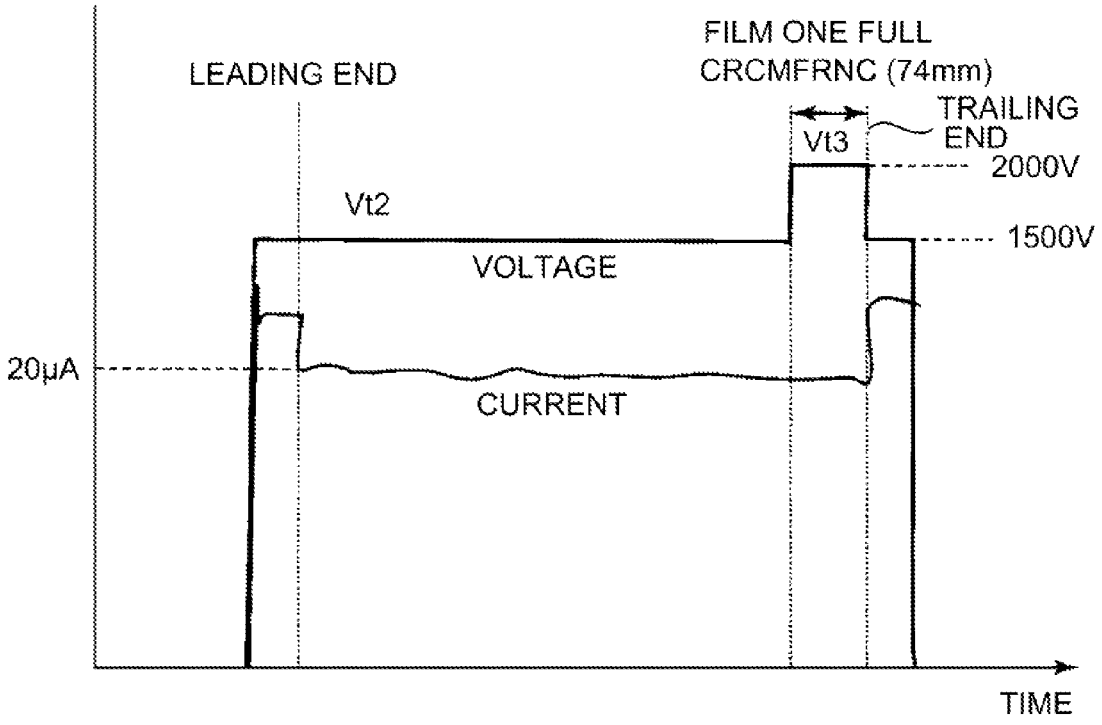
FIG. 7 is a time chart showing a relationship between a current and a voltage at a transfer portion during transfer of a toner image on a second surface in both-side image formation in Embodiment 1.

Next, referring to FIG. 7, the control used, in this embodiment in order to suppress the density difference (image density non-uniformity) in the above-described comparison example will be described. FIG. 7 shows a relationship between the current and the voltage at the secondary transfer portion N2 before and after the toner image is secondary-transferred onto the second surface of the transfer material F in the both-side image formation. This embodiment differs from the comparison example in the following point.

In this embodiment, in a period from the time when the position of 74 mm from the trailing end toward the leading end of the transfer material P on the second surface in the both-side image formation passes through the secondary transfer portion N2 to the time when the trailing end of the transfer material P on the second surface passes through the secondary transfer portion N2, the set voltage of the secondary transfer voltage was changed to a set voltage Vt3 which is a value obtained by adding a correction voltage Vpα to the set voltage Vt2. In this embodiment, Vpα=500 V is set, so that the set voltage of the secondary transfer voltage was switched from Vt2−1500 V to Vt3=2000 V.

Figure 8:
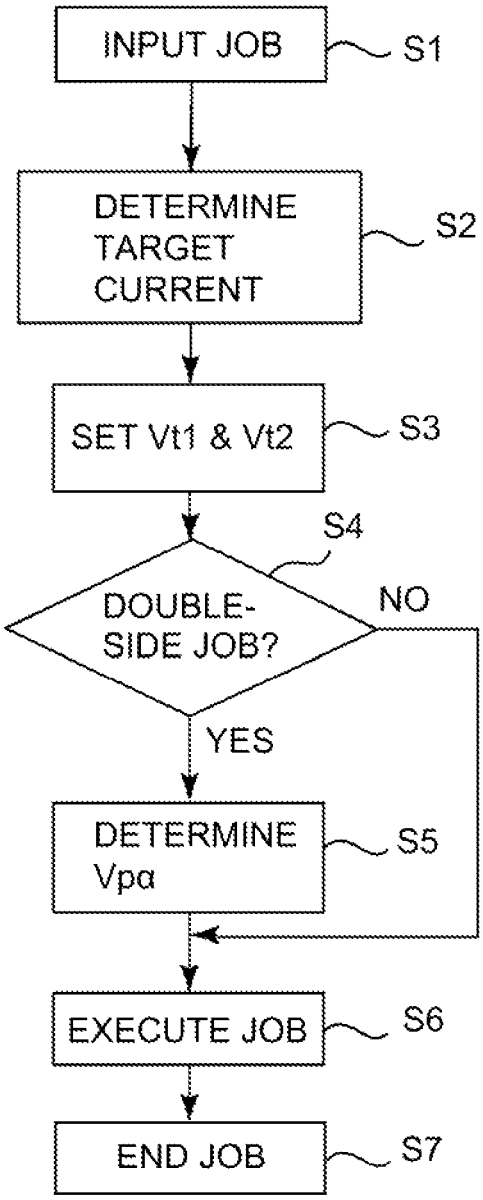
FIG. 8 is a flow chart showing a contact procedure in Embodiment 1.

Specifically, in this embodiment, the secondary transfer voltage is controlled in the following procedure. FIG. 8 is a flowchart showing an outline of the procedure of the control of the secondary transfer voltage in this embodiment. This control is effected at the controller 150. The flow chart of FIG. 8 shows the procedure simplified by paying attention to the control of the secondary transfer voltage in this embodiment, and other many control steps necessary for normal image formation are omitted.

First, when start of the job is inputted (S1), the controller 150 obtains environment information (temperature and humidity information) by the environment sensor 155, and obtains information of the species (paper species) of the transfer material P selected at the operating portion 156. Then, a target current used is determined from a plurality of target currents set in advance depending on the environment and the species (paper species) of the transfer material P (S2). Then, the controller 150 executes the ATVC of the secondary transfer voltage at the determined target current, and then sets set values Vt1 and Vt2 (S3). Then, the controller 150 discriminates whether or not the job is a job for the both-side image formation (S4). In the case where the controller 150 discriminates that the job is the job for the both-side image formation in S4 ("YES" of S4), the controller 150 determines the correction voltage Vpα, to be used, from the plurality of correction voltages set in advance depending on the environment and the species (paper species) of the transfer material P (S5), Then, the controller 150 executes the both-side image formation job by using the following set voltages Vt1, Vt2 and Vt3 (S6).

Set voltage during secondary transfer of toner image on first surface: Vt1=Vt+Vp1 (Vp1=0 in this embodiment)

Set voltage during secondary transfer of toner image on second surface from leading end to position of 74 mm from trailing end toward leading end; Vt2=Vt+Vp2

Set voltage during secondary transfer of toner image on second surface from position of 74 mm (from trailing end) toward leading end to trailing end; Vt3=Vt2+Vpα

Thereafter, the controller 150 ends the job when the image formation of a desired number of sheets is ended (S7).

In the case where the controller 150 discriminates that the job is not the both-side image formation job in S4 ("NO" of S4), the controller 150 executes a one-side (surface) image formation job by using the set voltage Vt1 (S6), and then ends the job (S7).

As shown in FIG. 7, in this embodiment, at the position of 74 mm from the trailing end toward the leading end of the transfer material P on the second surface in the both-side image formation, the set voltage of the secondary transfer voltage is switched from Vt2=1500 V to Vt3=Vt2+Vpα=2000 V. As a result, it is understood that the transfer current of 20 μA uniformly flows through the transfer material P on the second surface in the both-side image formation from the leading end to the trailing end of the transfer material P uniformly. As a result, a uniform transfer property is obtained in an entire region of the transfer material P, with the result that a good image with a suppressed density difference (image density non-uniformity) is obtained.

The correction voltage Vpα is set on the basis of a result obtained in advance by an experiment or the like. In this case, as described above, the correction voltage Vpα is set for every environment and species (paper species) of the transfer material P. Then, the correction voltage Vpα is selected depending on the environmental condition during the execution of the job and the species (paper species) of the transfer material P set by a user and so on in the job. This is because the correction voltage meets a phenomenon that a degree of electric resistance non-uniformity (non-uniformity of water vaporization amount) generating along the feeding direction of the transfer material F in the fixing step of the toner image on the second surface in the both-side image formation varies depending on the environment and the species (paper species) of the transfer material P. In this embodiment, the correction voltage Vpα is set depending on both of the environment and the species (paper species) of the transfer material P, but may also be set depending on either one of the environment and the species of the transfer material P. Further, in this embodiment, the environment is divided into certain temperature and humidity ranges (low temperature and low humidity environment (temperature; 15° C., humidity: 10% RH), normal temperature and normal humidity environment (temperature: 23° C., humidity: 60% RH) and high temperature and high humidity environment (temperature: 30° C., humidity: 80% RH)), and then the correction voltage Vpα was set depending on the divided temperature and humidity range (environment). For example, in the case where it is known that a difference in water content vaporizing from the transfer material P relative to a difference in thermal quantity supplied in the fixing step becomes larger with a higher temperature and higher humidity environment, the correction voltage Vpα can be made larger with the higher temperature and higher humidity environment. However, in the case where it is known that either one of the temperature and the humidity and a proper correction voltage Vpα correlate with each other, the correction voltage Vpα may also be set depending on either one of the temperature and the humidity. As the difference in species (paper species) of the transfer material F, it is possible to cite a difference in basis weight, surface property or the like. For example, in the case where it is known that a difference in water content vaporizing from the transfer material F relative to a difference in thermal quantity supplied in the fixing step becomes larger with a larger basis weight or a rougher surface property, the correction voltage Vpα can be made larger with the larger basis weight or the rougher surface property.

As described above, in this embodiment, the image forming apparatus 100 includes the heating means 50 for heating the transfer material P, on which the toner image is transferred, at the heating portion N3. In this embodiment, the heating means 50 includes the rotatable member 51 rotating in contact with the transfer material P while heating the transfer material P at the heating portion N3. The image forming apparatus 100 includes a feeding means 80 for feeding the transfer material P, to the transfer portion N2, heated by the heating means 50 in the both-side image formation in which the images are formed on the first surface and the second surface of the transfer material P. Further, the image forming apparatus 100 includes the control means 100 for controlling the transfer voltage. In this embodiment, the control means 150 changes the transfer voltage in the following manner when the transfer material P passes through the transfer portion N2 in order to transfer the toner image on the second surface in the both-side image formation. That is, the transfer voltage is changed between different regions of the transfer material passing through the heating portion N3 during rotations of the rotatable member 51 through different one full circumferences, respectively. Particularly, in this embodiment, the transfer voltage is changed between a period in which the region passes through the heating portion N3 during the rotation through a first one full circumference and a period in which the region passes through the heating portion N3 during the rotation through a second one full circumference and later. At that time, an absolute value of the transfer voltage in the period in which the region passed through the heating portion N3 during the rotation through the first one full circumference passes through the transfer portion N2 is made larger than an absolute value of the transfer voltage in the period in which the region passed through the heating portion N3 during the rotation through the second one full circumference later passes through the transfer portion N2. In other words, the control means 150 changes the transfer voltage between periods in which different regions, with respect to the feeding direction of the transfer material P, in which the thermal quantities supplied by the heating means 50 during the transfer of the toner image on the second surface are different from each other, pass through the transfer portion N2. Further, in other words, the control means 150 changes the transfer voltage between periods in which different regions, with respect to the feeding direction of the transfer material P, in which the electric resistances are different from each other by heating the transfer material P by the heating means 50 during the transfer of the toner image on the second surface, pass through the transfer portion N2.

As described above, according to this embodiment, during the secondary transfer of the toner image on the second surface in the both-side image formation, by changing the set voltage of the secondary transfer voltage correspondingly to the degree of the electric resistance non-uniformity of the transfer material P caused by the influence of the fixing device 50, a good image with suppressed image difference (image density non-uniformity) can be obtained.

Embodiment 2

Next, another embodiment of the present invention will be described. Basic constitutions and operations of the image forming apparatus in this embodiment are the same as those in Embodiment 1. Accordingly, elements having the same or corresponding functions and constitutions are represented by the same reference numerals or symbols and will be omitted from detailed description.

Figure 9:
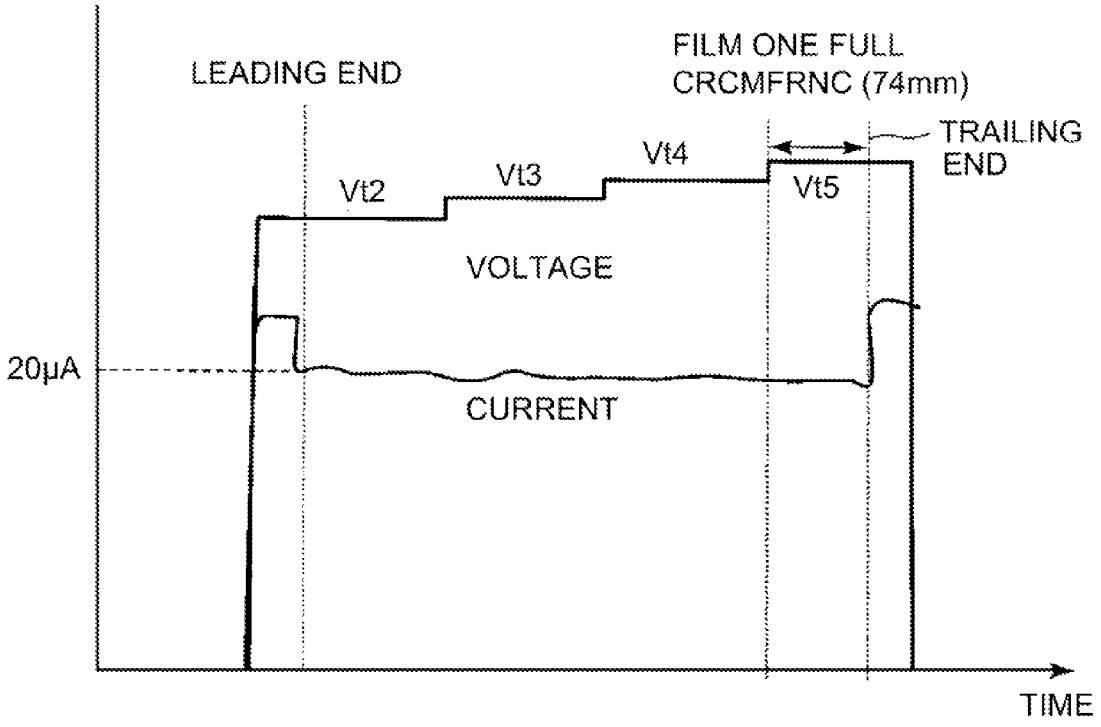
FIG. 9 is a time chart showing a relationship between a current and a voltage at a transfer portion during transfer of a toiler image on a second surface in both-side image formation in Embodiment 2 of the present invention.

FIG. 9 shows a relationship between the current and the voltage at the secondary transfer portion N2 before and after the toner image is secondary-transferred onto the second surface of the transfer material P in the both-side image formation in this embodiment. This embodiment differs from Embodiment 1 in that setting of the secondary transfer voltage is stepwisely switched every 74 mm, which is the rotation period of the fixing film 51, from the leading end of the transfer material P on the second surface in the both-side image formation with respect to the feeding direction of the transfer material P.

Specifically, in this embodiment, the setting of the secondary transfer voltage is Vt2=Vt+Vp2 in a range from the leading end of the transfer material P on the second surface in the both-side image formation to a first position of 74 mm from the leading end toward the trailing end. Next, in a range from the first position to a second position of 74 mm from the first position toward the trailing end (i.e., 148 mm from the leading end toward the trailing end), the secondary transfer voltage setting is Vt3=Vt2+1×Vpα. Next, in a range from the second position to a third position of 74 mm from the second position toward the trailing end (i.e., 222 mm from the leading end toward the trailing end), the secondary transfer voltage setting is Vt4=Vt2+2×Vpα. Next, in a range from the third position to the trailing end of the transfer material P on the second surface in the both-side image formation, the secondary transfer voltage setting is Vt5=Vt2+3×Vpα.

In this way, in this embodiment, with a period of 74 mm from the leading end of the transfer material P on the second surface in the both-side image formation, the correction voltage Vpα is successively added to the set voltage Vt2. That is, when a set voltage to be successively switched is Vtn (n: the number of times of switching), the set voltage Vtn can be represented by the following equation:

$$Vtn=Vt2+n\times Vp\alpha.$$

Here, similarly as in Embodiment 1, the correction voltage Vpα is set for every environment and species (paper species) of the transfer material P on the basis of a result obtained in advance by an experiment or the like.

As shown in FIG. 9, by effecting control in this embodiment, it becomes possible to make constant the transfer current of the transfer material P on the second surface during the secondary transfer in the both-side image formation by causing the transfer current to follow electric resistance non-uniformity of the transfer material P. Particularly, in the case where the amount of water contained in the transfer material P in the high temperature and high humidity environment or the like or in the case where moisture absorption and exhaust of the transfer material P is intense, not only the leading end portion of the transfer material P contacting the fixing film 51 during the rotation through the first one full circumference, but also another portion reacts remarkably to a change in temperature of the fixing film 51. For that reason, a difference in electric resistance generates over a broader range (e.g., the entire region) of the transfer material P with respect to the feeding direction of the transfer material P in some cases. In these cases, by employing the control in this embodiment, it becomes possible to suppress the density difference (image density non-uniformity) on the second surface of the transfer material P in the both-side image formation.

In this embodiment, the value of the secondary transfer voltage setting is changed so as to increase every rotation period of the fixing film 51 from the leading end to the trailing end of the second surface of the transfer material P in the both-side image formation, but the present invention is not limited to the manner of stepwisely changing the secondary transfer voltage in the entire region of the transfer material P with respect to the transfer material feeding direction. For example, the thermal quantity supplied from the fixing film 51 to the transfer material P is stabilized in some cases by passing of a part region from the leading end toward the trailing end of the transfer material P through the fixing portion N3 in the fixing step of the toner image on the first surface of the transfer material P in the both-side image formation. In such a case, during the secondary transfer of the toner image on the second surface of the transfer material P in the both-side image formation, in a region where the transfer material P contacts the fixing film 51 until the fixing film 51 rotates through a predetermined one full circumference in the fixing step of the toner image on the first surface, it is possible to generate the secondary transfer voltage setting so that the value of the secondary transfer voltage setting successively increases. Further, it would be also considered that in the entire region or a predetermined region in the leading end side with respect to the feeding direction of the transfer material P in the fixing step of the toner image on the first surface in the both-side image formation, the electric resistance value of the transfer material P is not stepwisely changed but is changed continuously (linearly or exponentially). In that case, the secondary transfer voltage during the secondary transfer of the toner image on the second surface may only be required to be changed continuously (linearly or exponentially) so as to adapt to an electric resistance change characteristic of the transfer material P by the fixing step of the toner image on the first surface.

As described above, in this embodiment, the control means 150 stepwisely changes the transfer voltage every rotation period of the rotatable member 51 during passing of at least a part of the region of the transfer material P with respect to the transfer material feeding direction through the transfer portion N2 in order to transfer the toner image on the second surface in the both-side image formation. Particularly, in this embodiment, the control means 150 stepwisely increases an absolute value of the transfer voltage from an end portion side, corresponding to the trailing end side of the transfer material P with respect to the transfer material feeding direction when the transfer material P on which the toner image is transferred on the first surface passes through the heating portion N3, toward another end portion side corresponding to the leading end side of the transfer material P.

As described above, according to this embodiment, by changing the secondary transfer voltage setting correspondingly to the electric resistance non-uniformity of the second surface of the transfer material in the both-side image formation over the range broader than that in Embodiment 1, a good image with suppressed density difference (image density non-uniformity) can be obtained.

Other Embodiments

The present invention was described based on the specific embodiments mentioned above, but is not limited to the above-mentioned embodiments.

For example, in the above-described embodiments, the image forming apparatus of the intermediary transfer type in which the toner images of the plurality of colors are primary-transferred superposedly onto the intermediary transfer member and thereafter are secondary-transferred onto the transfer material was described as an example. However, as the transfer type, other than the intermediary transfer type, there are transfer types including a multiple developing type in which the toner images of the plurality of colors are superposed on the surface of the photosensitive member and thereafter are collectively transferred onto the transfer material, and a direct transfer type in which the toner images of the plurality of colors are superposedly transferred from the photosensitive member onto the transfer material carried on and fed by a transfer material carrying member. Even in either one of these types, the present invention is applicable to the transfer portion where the toner images are transferred from the image bearing member such as the photosensitive member onto the transfer material.

In the above-described embodiments, the fixing device constituted by the heating device of the film heating type was described as an example, but the fixing device is not limited to this type. For example, the present invention is applicable to also the case where a fixing device constituted by a heating device of a roller heating type including a fixing belt as a rotatable fixing member provided with a heat source and a pressing roller as a rotatable pressing member press-contacted to the fixing roller is used. Further, also a fixing device constituted by a heating device of an electromagnetic induction heating type in which a metal-made film (heat generating layer) itself is caused to generate heat has been known, and the present invention can be applied to the case where this fixing device is used.

In the above-described embodiments, the case where the heating device as the heating means is the fixing device for fixing the unfixed toner image on the transfer material was described. However, in some cases, the image forming apparatus includes, as the heating device, in addition to the fixing device for fixing the unfixed toner image on the transfer material, a gloss-imparting device (image heating device) for heating again the transfer material, on which the toner image is once fixed, in order to improve, e.g., smoothness (gloss property) of the image or the like. In such a case, it would be considered that the transfer material electric resistance non-uniformity described with respect to the fixing device in the above-described embodiments generates in the gloss-imparting device by passing of the transfer material through the gloss-imparting device before the toner image is transferred onto the second surface of the transfer material in the both-side image formation. In such a case, the transfer voltage for transferring the toner image on the second surface of the transfer material in the both-side image formation can be changed correspondingly to the electric resistance non-uniformity generating on the transfer material in the gloss-imparting device. Further, the transfer voltage may also be changed correspondingly to the electric resistance non-uniformity generating on the transfer material in at least one of the fixing device and the gloss-imparting device.

Further, with downsizing and quick start of the image forming apparatus, there is a tendency that the rotatable fixing member such as the fixing film and the rotatable pressing member such as the pressing roller become small in diameter and thus the thermal capacity of the pressing roller becomes small. For that reason, in the case where heat of the pressing roller is taken by the transfer material by passing of the transfer material, in some cases, the fixing property of the toner image on the transfer material at a temperature-lowered portion (principally at the trailing end of the transfer material) becomes poor. Therefore, there is a constitution in which a target temperature setting for the fixing device is changed within a single (one) sheet of the transfer material by, e.g., increasing a fixing control temperature from the leading end toward the trailing end of the single sheet of the transfer material. As in this case, it would be considered that the transfer material electric resistance non-uniformity generates also in the case where the thermal quantity supplied from the rotatable fixing member to the transfer material is positively made different between regions different in transfer material feeding direction from the viewpoint of the fixing property. Accordingly, also in such a case, by applying the present invention, the transfer voltage when the toner image is transferred onto the second surface of the transfer material in the both-side image formation can be changed correspondingly to the electric resistance non-uniformity. In this case, it is possible to arbitrarily select a manner of changing the transfer voltage correspondingly to the electric resistance non-uniformity, e.g., by changing the transfer voltage so that the transfer voltage in the leading end side of the second surface of the transfer material is made large correspondingly to an increase in electric resistance in the trailing end side of the first surface of the transfer material in the both-side image formation in a reverse manner to that in the above-described embodiments.

In the above-described embodiments, the case where the transfer material feeding direction during the toner image transfer is inverted between the first surface and the second surface of the transfer material in the both-side image formation was described, but the present invention is not limited thereto. Even in the case where the transfer material feeding direction is unchanged between the toner image transfer on the first surface and the toner image transfer on the second surface, the transfer voltage during the toner image transfer on the second surface may only be required to be changed correspondingly to the direction of the electric resistance non-uniformity generating on the transfer material before the toner image transfer on the second surface.

In Embodiment 1, the case where the transfer material electric resistance non-uniformity generates between the region corresponding to one full circumference of the fixing film from the leading end of the first surface of the transfer material and a subsequent region and later in the both-side image formation was described, but the present invention is not limited thereto. In the case where the transfer material electric resistance non-uniformity generates between a region corresponding to a movement amount more than or less than the one full circumference of the fixing film (in this case, the movement amount is not restricted to an integral multiple of the one full circumference) and another region, it is possible to change the transfer voltage during the transfer corresponding to the rotation of the fixing film through the second one full circumference. Similarly, in Embodiment 2, the transfer voltage is changed every one full circumference region of the fixing film during the transfer of the toner image on the second surface in the both-side image formation, but the transfer voltage may also be changed every region corresponding to a movement amount more than or less than the one full circumference of the fixing film (in this case, the movement amount is not restricted to an integral multiple of the one full circumference).

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-163220 filed on Aug. 3, 2014, which is hereby incorporated by reference herein in its entirety.

What is claimed is:

1. An image forming apparatus comprising:

an image bearing member for bearing a toner-image;

a voltage source for applying a transfer voltage to a transfer portion where the toner image is transferred from said image bearing member onto a recording material;

a fixing device, including a rotatable member to be heated, for fixing the toner image on the recording material by heating the recording material, on which the toner image is transferred, at a fixing portion while causing the recording material to contact the rotatable member;

an executing portion for executing an operation in a both-side mode in which the recording material, on which the toner image is transferred and fixed on a first surface thereof, is fed to the transfer portion, to which the transfer voltage is applied, where the toner image is transferred onto a second surface of the recording material and then is fixed on the second surface of the recording material by said fixing device to form both-side images; and a setting portion for setting the transfer voltage when the toner image is transferred onto the second surface of the recording material, wherein said setting portion sets the transfer voltage in the operation for the second surface in the both-side mode so that an absolute value of the transfer voltage when a recording material region, which starts from a downstreammost end position with respect to a recording material feeding direction and which passed through the fixing portion through a first one full circumference of the rotatable member when the toner image is fixed on the first surface, passes through the transfer portion is greater than an absolute value of the transfer voltage when a recording material region passed through the fixing portion through a second one full circumference of the rotatable member when the toner image is fixed on the first surface passes through the transfer portion.

2. An image forming apparatus according to claim 1, wherein said fixing device includes an endless belt which is the rotatable member, a heater and a pressing member, and wherein the belt is sandwiched in the fixing portion by being urged toward said heater by said pressing member.

3. An image forming apparatus according to claim 2, wherein said heater is provided on an inner peripheral surface of said belt, and wherein said pressing member is press-contacted to said belt toward said heater.

4. An image forming apparatus according to claim 1, further comprising a detecting member for detecting at least one of an ambient temperature or an ambient humidity of said image forming apparatus, and wherein said setting portion sets the transfer voltage depending on a detection result of said detecting member.

5. An image forming apparatus according to claim 1, further comprising an input portion into which information on a type of the recording material is to be inputted, and wherein said setting portion sets the transfer voltage depending on the information inputted in said input portion.

6. An image forming apparatus according to claim 1, wherein the transfer voltage applied to the transfer portion is subjected to constant-voltage control.

7. An image forming apparatus according to claim 1, wherein the recording material region passed through the fixing portion through the first one full circumference of the rotatable member when the toner image is transferred onto the second surface is positioned downstream of the recording material region passed through the fixing portion through the second one full circumference of the rotatable member with respect to the recording material feeding direction.

8. An image forming apparatus comprising:

an image bearing member for bearing a toner image;

a voltage source for applying a transfer voltage to a transfer portion where the toner image is transferred from said image bearing member onto a recording material;

a fixing device, including a rotatable member to be heated, for fixing the toner image on the recording material by heating the recording material, on which the toner image is transferred, at a fixing portion while causing the recording material to contact the rotatable member;

an executing portion for executing an operation in a both-side mode in which the recording material, on which the toiler image is transferred and fixed on a first surface thereof, is fed to the transfer portion, to which the transfer voltage is applied, where the toner image is transferred onto a second surface of the recording material and then is fixed on the second surface of the recording material by said fixing device to form both-side images; and a setting portion for setting the transfer voltage when the toner image is transferred onto the second surface of the recording material, wherein said setting portion sets the transfer voltage in the operation for the second surface in the both-side mode so that an absolute value of the transfer voltage when a recording material region, where a heat quantity supplied by the rotatable member when the toner image is fixed on the first surface is a first heat quantity, passes through the transfer portion is greater than an absolute value of the transfer voltage when a recording material region, where the heat quantity supplied by the rotatable member when the toner image is fixed on the first surface is a second heat quantity less than the first heat quantity, passes through the transfer portion.

9. An image forming apparatus comprising:

an image bearing member for bearing a toner image;

a voltage source for applying a transfer voltage to a transfer portion where the toner image is transferred from said image bearing member onto a recording material;

a fixing device, including a rotatable member to be heated, for fixing the toner image on the recording material by heating the recording material, on which tine toner image is transferred, at a fixing portion while causing the recording material to contact the rotatable member;

an executing portion for executing an operation in a both-side mode in which the recording material, on which the toner image is transferred and fixed on a first surface thereof, is fed to the transfer portion, to which the transfer voltage is applied, where the toner image is transferred onto a second surface of the recording material and then is fixed on the second surface of the recording material by said fixing device to form both-side images; and a setting portion for setting the transfer voltage when the toner image is transferred onto the second surface of the recording material, wherein said setting portion sets the transfer voltage in the operation for the second surface in the both-side mode so that an absolute value of the transfer voltage when a recording material region, which has a first electric resistance by being heated by the rotatable member when the toner image is fixed on the first surface, passes through the transfer portion is greater than an absolute value of the transfer voltage when a recording material region, which has a second electric resistance lower than the first electric resistance by being heated by the rotatable member when the toner image is fixed on the first surface, passes through the transfer portion.

10. An image forming apparatus comprising:

an image bearing member for bearing a toner image;

a voltage source for applying a transfer voltage to a transfer portion where the toner image is transferred from said image bearing member onto a recording material;

a heating device, including a rotatable member to be heated, for heating the recording material at a heating portion while causing the recording material to contact the rotatable member;

an executing portion for executing an operation in a mode in which the recording material passed through said heating device is fed to the transfer portion, to which the transfer voltage is applied, where the toner image is transferred onto the recording material; and a setting portion for setting the transfer voltage when the toner image is transferred onto a second surface of the recording material, wherein said setting portion sets the transfer voltage in the operation for the second surface in the mode so that an absolute value of the transfer voltage when a recording material region, which starts from a downstreammost end position with respect to a recording material feeding direction and which passed through the heating portion through a first one full circumference of the rotatable member when the recording material is passed through said heating device, is greater than an absolute value of the transfer voltage when a recording material region passed through the heating portion through a second one full circumference of the rotatable member when the recording material is passed through said heating device.

* * * * *